US009751297B1

(12) United States Patent
Sheu et al.

(10) Patent No.: US 9,751,297 B1
(45) Date of Patent: Sep. 5, 2017

(54) SURFACE TREATMENT METHOD FOR COMPOSITE SURFACES

(71) Applicant: HON HAI PRECISION INDUSTRY CO., LTD., New Taipei (TW)

(72) Inventors: Yi-Zhong Sheu, New Taipei (TW); Chih-Jung Chang, New Taipei (TW); Hung-Chun Ma, New Taipei (TW); Han-Lung Lee, New Taipei (TW); Han-Lung Chao, New Taipei (TW); Jih-Chen Liu, New Taipei (TW); Feng-Yuen Dai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/170,956

(22) Filed: Jun. 2, 2016

(30) Foreign Application Priority Data

Apr. 15, 2016 (CN) ..... 2016 1 0233465

(51) Int. Cl.
*B41J 11/00* (2006.01)
*B41J 2/01* (2006.01)
*B41M 7/00* (2006.01)

(52) U.S. Cl.
CPC ..... *B41J 2/01* (2013.01); *B41J 11/0015* (2013.01); *B41M 7/0027* (2013.01)

(58) Field of Classification Search
CPC ..... B41J 2/01; B41J 11/0015; B41J 2/315; B41M 7/0027
See application file for complete search history.

(56) References Cited

U.S. PATENT DOCUMENTS

2004/0241355 A1* 12/2004 Yoshinari ..... B41C 1/1091 428/32.87
2006/0204886 A1* 9/2006 Nakamura ..... B41M 5/395 430/270.1
2011/0155007 A1* 6/2011 Liu ..... B41M 7/0027 101/368
2012/0003489 A1* 1/2012 Ying ..... B44C 1/105 428/469

* cited by examiner

*Primary Examiner* — Manish S Shah
*Assistant Examiner* — Yaovi M Ameh
(74) *Attorney, Agent, or Firm* — Steven Reiss

(57) ABSTRACT

A surface treatment method for a composite surface of a basic casing is provided. The composite surface is cooperatively formed by an outer surface and four sidewalls surrounding the outer surface. The surface treatment method includes following steps. A heat transferring film is provided. A printing pattern film is formed on a portion of the heat transferring film via a digital inkjet printing process. The heat transferring film is formed on the composite surface via a vacuum heat transfer process, with edges of the heat transferring film being wrapped around the sidewalls and the printing pattern firm being attached to the outer surface.

1 Claim, 6 Drawing Sheets

SURFACE TREATMENT METHOD FOR COMPOSITE SURFACES

FIELD

The subject matter herein generally relates to a surface treatment method, and more particularly, to a surface treatment method for a composite surface.

BACKGROUND

Basic casings of electronic devices (such as mobile phones, tablet computers, and multimedia players) may include a composite surface cooperatively formed by a flat outer surface and four sidewalls. A surface treatment method for such a basic casing may be complicated. Under some circumstance for example, a protective film is required to be formed on and fully wrapped around the composite surface via a surface treatment method to protect the electronic device from being damaged. The protective film may also need decorative patterns.

BRIEF DESCRIPTION OF THE DRAWINGS

Implementations of the present technology will now be described, by way of example only, with reference to the attached figures.

DETAILED DESCRIPTION

Figure 1:
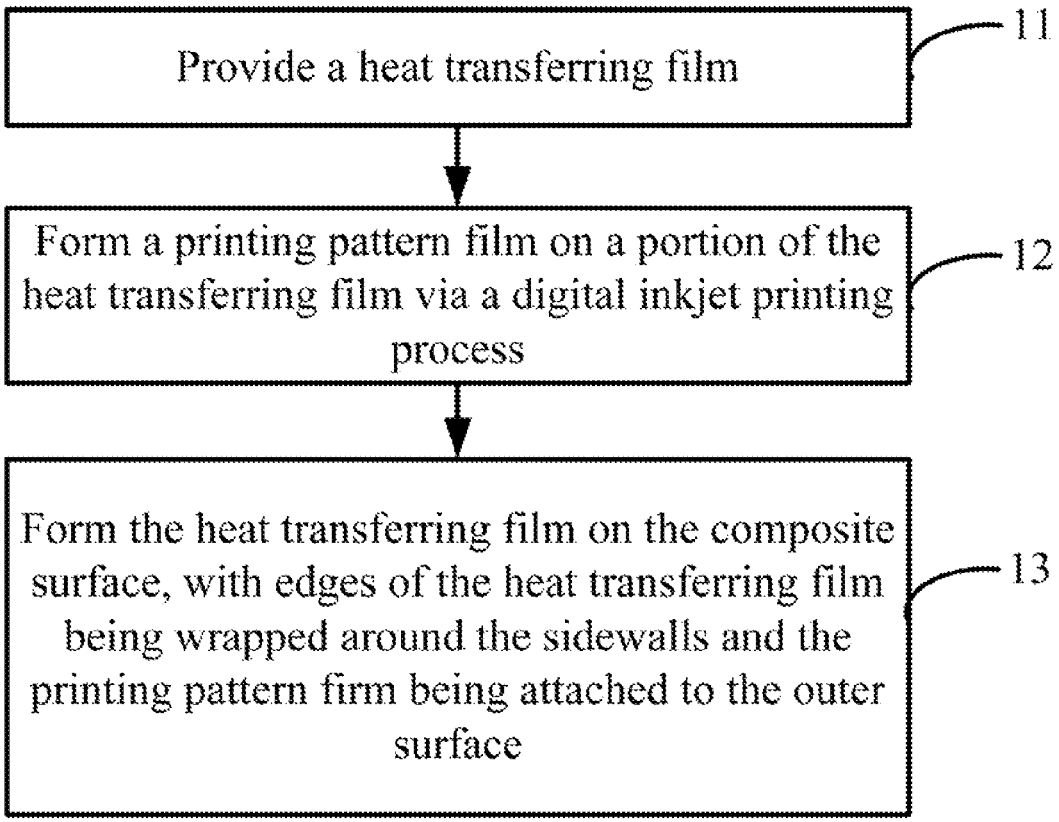
FIG. 1 is a flowchart of an embodiment of a surface treatment method for a composite surface.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The term "comprising," when utilized, means "including, but not necessarily limited to"; it specifically indicates open-ended inclusion or membership in the so-described combination, group, series, and the like.

Referring to FIG. 1, a flowchart is presented in accordance with an example embodiment which is being thus illustrated. The example surface treatment method for a composite surface of a basic casing 10 (shown in FIG. 5) is provided by way of example, as there are a variety of ways to carry out the method. The composite surface is cooperatively formed by an outer surface 11 and four sidewalls 12 surrounding the outer surface 11. Each block shown in FIG. 1 represents one or more processes, methods, or subroutines carried out in the exemplary method. Additionally, the illustrated order of blocks is by example only and the order of the blocks can change. The exemplary method can begin at block 11.

Figure 2:
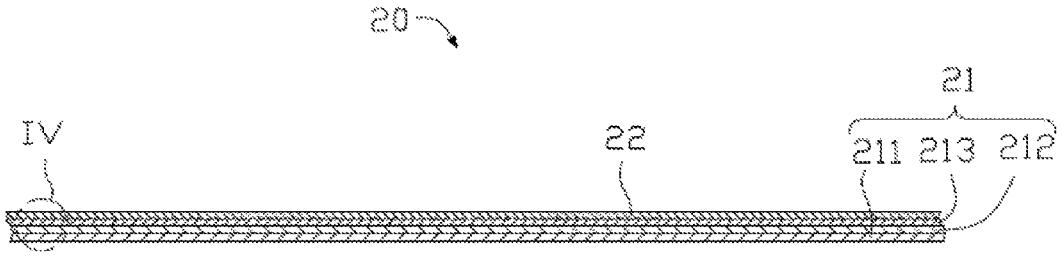
FIG. 2 is a diagrammatic view of an embodiment of a heat transferring film used in the surface treatment method of FIG. 1.

At block 11, referring to FIG. 2, a heat transferring film 20 is provided.

In at least one embodiment, the heat transferring film 20 comprises a heat pressing layer 21 and a releasing film layer 22 attached to a surface of the heat pressing layer 21. The releasing film layer 22 is made of a water soluble material capable of extending toward two orthogonal axes. In at least one embodiment, the releasing film layer 22 is made of polyvinyl alcohol or polyethylene terephthalate.

In at least one embodiment, the heat pressing layer 21 comprises a glue layer 211, a pattern layer 212, and a first protective layer 213 connected in that order. The releasing film layer 22 is attached to a surface of the first protective layer 213 away from the glue layer 211. Since the pattern layer 212 is sandwiched between the first protective layer 213 and the glue layer 211, the first protective layer 213 can prevent the pattern layer 212 from being damaged under an exterior force.

In at least one embodiment, the glue layer 211 is made of a hot glue which can be melted onto the basic casing 10 when being heated. The first protective layer 213 is made of a transparent resin, and can be formed by spraying, coating, planographic printing, or screen printing.

Figure 3:
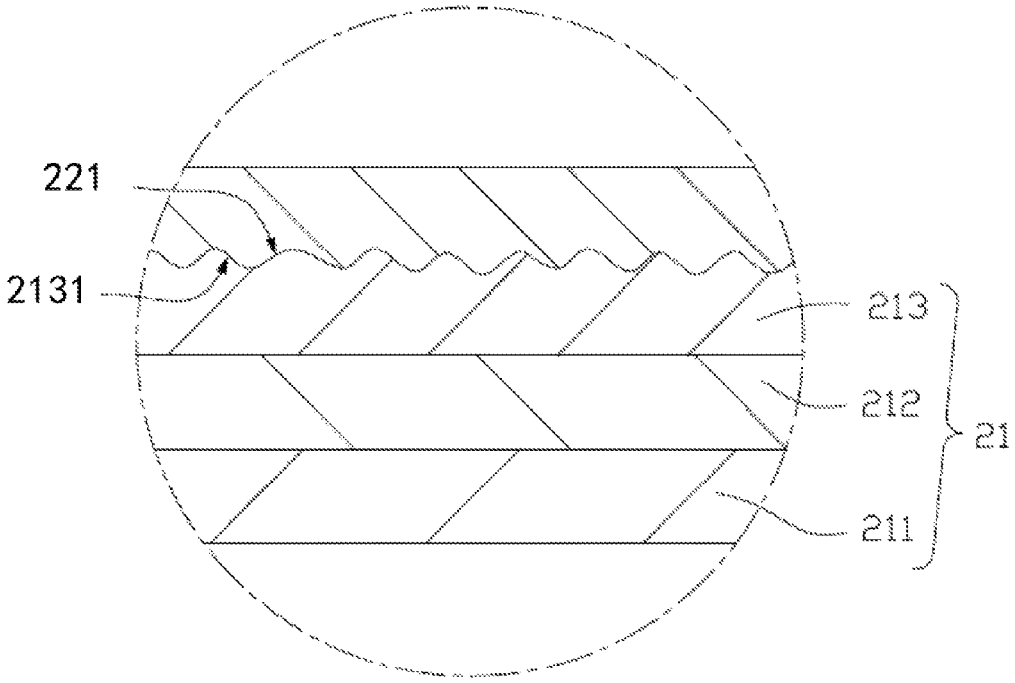
FIG. 3 is a sectional diagrammatic view of the heat transferring film within circular portion IV of FIG. 2.

Referring to FIG. 3, a surface of the releasing film layer 22 attached to the first protective layer 213 comprises a plurality of microstructures 221. The microstructures 221 are three dimensional (3D) curved structures formed by embossing or engraving. A surface of the first protective layer 213 attached to the releasing film layer 22 also comprises microstructures 2131 which match the microstructures 221 in shape.

Figure 4:
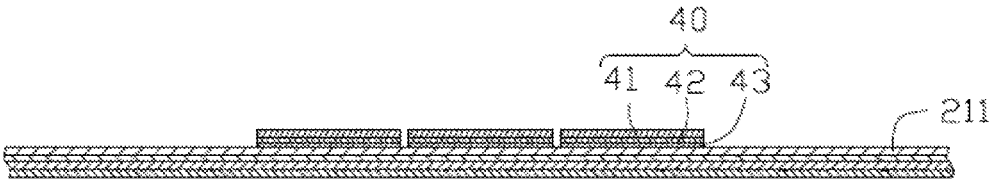
FIG. 4 is a diagrammatic view showing a printing pattern film being formed on the heat transferring film of FIG. 2.

At block 12, referring to FIG. 4, a printing pattern film 40 is formed on a portion of the heat transferring film 20 via a digital inkjet printing process.

In at least one embodiment, the printing pattern film 40 comprises a basic layer 41, a printing pattern layer 42, and a second protective layer 43 connected in that order. The printing pattern layer 42 comprises desired patterns. The second protective layer 43 is attached to a surface of the portion of the glue layer 211 away from the first protective layer 212.

In other embodiments, the printing pattern film 40 can further comprise an empty layer (not shown) sandwiched between the basic layer 41 and the printing pattern 42.

In at least one embodiment, the printing pattern film 40 is formed via the digital inkjet printing process as follows.

A printing head of the ultraviolet ink jet printer is controlled to output glossy inks onto a surface of the glue layer 211 away from the first protective layer 213, and at least one ultraviolet lamp of the ultraviolet ink jet printer is controlled to emit ultraviolet light which can solidify the glossy inks to form the second protective layer 43. A second printing head of the ultraviolet ink jet printer is controlled to output color inks onto a surface of the second protective layer 43 away from the glue layer 211, and the ultraviolet lamp is controlled to emit ultraviolet light which can solidify the color inks to form the printing pattern layer 42. Then, a third printing head of the ultraviolet ink jet printer is controlled to output basic inks onto a surface of the printing pattern layer 42 away from the second protective layer 43, and the ultraviolet lamp is controlled to emit ultraviolet light which can solidify the basic inks to form the basic layer 41. Thus, the printing pattern film 40 is formed.

Figure 5:
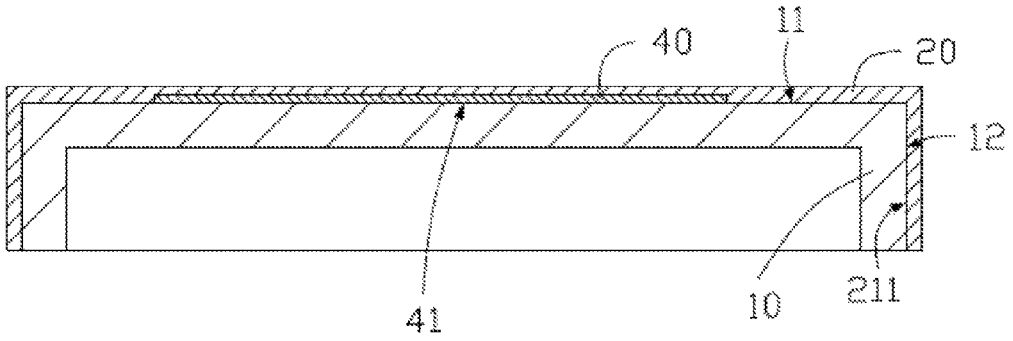
FIG. 5 is a diagrammatic view showing the heat transferring film of FIG. 4 being wrapped around a composite surface of a basic casing to form a finished casing.
Figure 6:
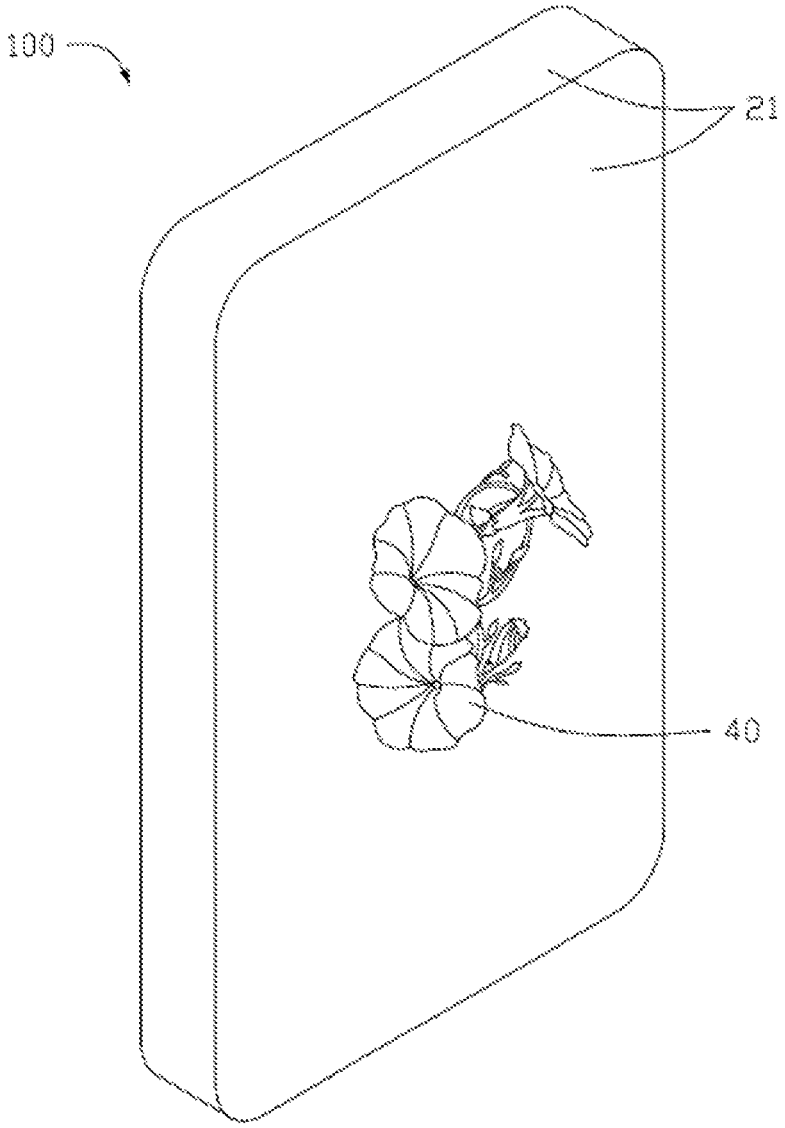
FIG. 6 is a diagrammatic view of the finished casing of FIG. 5 from another angle.

At block 13, referring to FIG. 5, the heat transferring film 20 is formed on the composite surface via a vacuum heat transfer process, with edges of the heat transferring film 20 being wrapped around the sidewalls 12 and the printing pattern film 40 being attached to the outer surface 11, thereby forming a finished casing 100 (shown in FIG. 6). In at least one embodiment, the basic casing 10 is used in a portable electronic device such as a mobile phone or a tablet computer. In at least one embodiment, the glue layer 211 of the heat transferring film 20 and the basic layer 41 of the printing pattern film 40 become attached to the outer surface 11.

In at least one embodiment, the vacuum heat transfer process can be carried out by forming the heat transferring film 20 on the composite surface under conditions of temperature and vacuum pressure using a heat pressing machine (not shown), and removing the releasing film layer 22 of the heat transferring film 20 to expose the heat pressing layer 21, thereby forming the finished casing 100.

With the above configuration, since the releasing film layer 22 is made of a water soluble material capable of extending toward two orthogonal axes, the heat transferring film 20 bends and flexes to match the shape of the composite surface via the vacuum heat transfer process, thereby allowing the edges of heat transferring film 20 to be fully wrapped around the sidewalls 12. After the releasing film layer 22 is removed, the microstructures 2131 of the first protective layer 213 are exposed, this brings a new level of tactile experience to the user when the finished casing 100 is handled. Furthermore, the finished casing 100 can have an improved 3D appearance when the microstructures 2131 of the first protective layer 213 are combined with the patterns of the pattern layer 212 and the printing pattern layer 42.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A surface treatment method for a composite surface of a basic casing, the composite surface cooperatively formed by an outer surface and four sidewalls surrounding the outer surface, the surface treatment method comprising:

providing a heat transferring film;

forming a printing pattern film on a portion of the heat transferring film via a digital inkjet printing process; and forming the heat transferring film on the composite surface via a vacuum heat transfer process, with edges of the heat transferring film being wrapped around the sidewalls and the printing pattern film being directly attached to the outer surface;

wherein the printing pattern film comprises a basic layer, a printing pattern layer connected to a surface of the basic layer, and a second protective layer connected to a surface of the printing pattern layer facing away from the basic layer, the second protective layer is attached to the portion of the heat transferring film;

wherein the heat transferring film comprises a heat pressing layer and a releasing film layer attached to a surface of the heat pressing layer;

wherein the heat pressing layer comprises a glue layer, a pattern layer, and a first protective layer connected in that order; the releasing film layer is attached to a surface of the first protective layer away from the glue layer;

wherein the second protective layer of the printing pattern film is attached to a surface of the glue layer facing away from the first protective layer.

* * * * *